US010780691B2

(12) United States Patent
Sohgawa

(10) Patent No.: US 10,780,691 B2
(45) Date of Patent: Sep. 22, 2020

(54) DRIVE WAVEFORM GENERATING DEVICE, LIQUID DISCHARGE APPARATUS, AND HEAD DRIVING METHOD

(71) Applicant: Norimasa Sohgawa, Kanagawa (JP)

(72) Inventor: Norimasa Sohgawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/299,267

(22) Filed: Mar. 12, 2019

(65) Prior Publication Data

US 2019/0283411 A1 Sep. 19, 2019

(30) Foreign Application Priority Data

Mar. 19, 2018 (JP) ..... 2018-050913

(51) Int. Cl.
*B41J 2/045* (2006.01)

(52) U.S. Cl.
CPC ..... *B41J 2/04588* (2013.01); *B41J 2/04586* (2013.01)

(58) Field of Classification Search
CPC ..... B41J 2/04596
See application file for complete search history.

(56) References Cited

U.S. PATENT DOCUMENTS 9,895,883 B1 * 2/2018 Seto ..... B41J 2/04588
2002/0033852 A1 * 3/2002 Chang ..... B41J 2/04581 347/9
2011/0063351 A1 * 3/2011 Kitaoka ..... B41J 2/04581 347/11
2017/0066236 A1 3/2017 Sohgawa et al.
2018/0250931 A1 * 9/2018 Sakamoto ..... B41J 2/04588

FOREIGN PATENT DOCUMENTS

JP 2003-118107 4/2003
JP 2015-174401 10/2015

* cited by examiner

*Primary Examiner* — Shelby L Fidler
(74) *Attorney, Agent, or Firm* — Harness, Dickey and Pierce, P.L.C.

(57) ABSTRACT

A drive waveform generating device includes circuitry configured to generate a drive waveform to be applied to a pressure generation element of a liquid discharge head. The drive waveform including a first waveform and a second waveform continuous in time series with the first waveform. The first waveform includes a falling element to lower a potential from an intermediate potential to a lower potential lower than the intermediate potential, a raising element to raise the potential from the lower potential to a higher potential higher than the intermediate potential, and a potential holding element to hold the higher potential. The second waveform includes a raising element to raise the potential from the intermediate potential to a raised potential higher than the intermediate potential, a potential holding element to hold the raised potential, and a falling element to lower the potential from the raised potential to the intermediate potential.

18 Claims, 11 Drawing Sheets

DRIVE WAVEFORM GENERATING DEVICE, LIQUID DISCHARGE APPARATUS, AND HEAD DRIVING METHOD

CROSS-REFERENCE TO RELATED APPLICATIONS

This patent application is based on and claims priority pursuant to 35 U.S.C. § 119(a) to Japanese Patent Application No. 2018-050913, filed on Mar. 19, 2018, in the Japan Patent Office, the entire disclosure of which is hereby incorporated by reference herein.

BACKGROUND

Technical Field

The present disclosure relates to a drive waveform generating device, a liquid discharge apparatus, and a head driving method.

Discussion of the Background Art

In an apparatus using a liquid discharge head, to prevent increases in viscosity of liquid, micro vibration driving (also referred to as micro vibration, non-discharge driving, or preliminary discharge) is performed to shake the meniscus of a nozzle to such an extent that no droplet is discharged.

A pulse for discharging a liquid is called "discharge pulse". Conventionally used is a discharge pulse including a raising waveform element that rises in two stages. A second stage includes a voltage holding waveform element and a raising waveform element, which are used as a micro vibrating pulse.

SUMMARY

According to an aspect of this disclosure, a drive waveform generating device includes circuitry configured to generate a drive waveform to be applied to a pressure generation element of a liquid discharge head. The drive waveform including a first waveform and a second waveform continuous in time series with the first waveform. The first waveform includes a falling element to lower a potential from an intermediate potential to a lower potential lower than the intermediate potential, a raising element to raise the potential from the lower potential to a higher potential higher than the intermediate potential, and a potential holding element to hold the higher potential. The second waveform includes a raising element to raise the potential from the intermediate potential to a raised potential higher than the intermediate potential, a potential holding element to hold the raised potential, and a falling element to lower the potential from the raised potential to the intermediate potential.

According to another aspect of this disclosure, a liquid discharge apparatus includes a liquid discharge head and drive waveform generating device described above. The liquid discharge head includes a nozzle configured to discharge liquid and the pressure generation element configured to generate a pressure to discharge liquid from the nozzle.

Yet another aspect concerns a method for applying a drive waveform to a pressure generation element of a liquid discharge head to drive the liquid discharge head. The method includes generating the drive waveform to be applied to the pressure generation element. The drive waveform includes the first waveform described above and a second waveform. The second waveform is discontinuous with the potential holding element of the first waveform. The second waveform includes a raising element to raise the potential from the intermediate potential to a raised potential higher than the intermediate potential, a potential holding element to hold the raised potential, and a falling element to lower the potential from the raised potential to the intermediate potential. The method further includes performing discharge driving to drive the liquid discharge head to discharge liquid. The discharge driving includes inputting the first waveform to the pressure generation element; interrupting an input of the first waveform to the pressure generation element while the higher potential is held in the first waveform, and inputting the second waveform to the pressure generation element while the raised potential is held in the second waveform. The method further includes performing non-discharge driving to drive the liquid discharge head not to discharge the liquid. The non-discharge driving includes inputting the second waveform to the pressure generation element.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
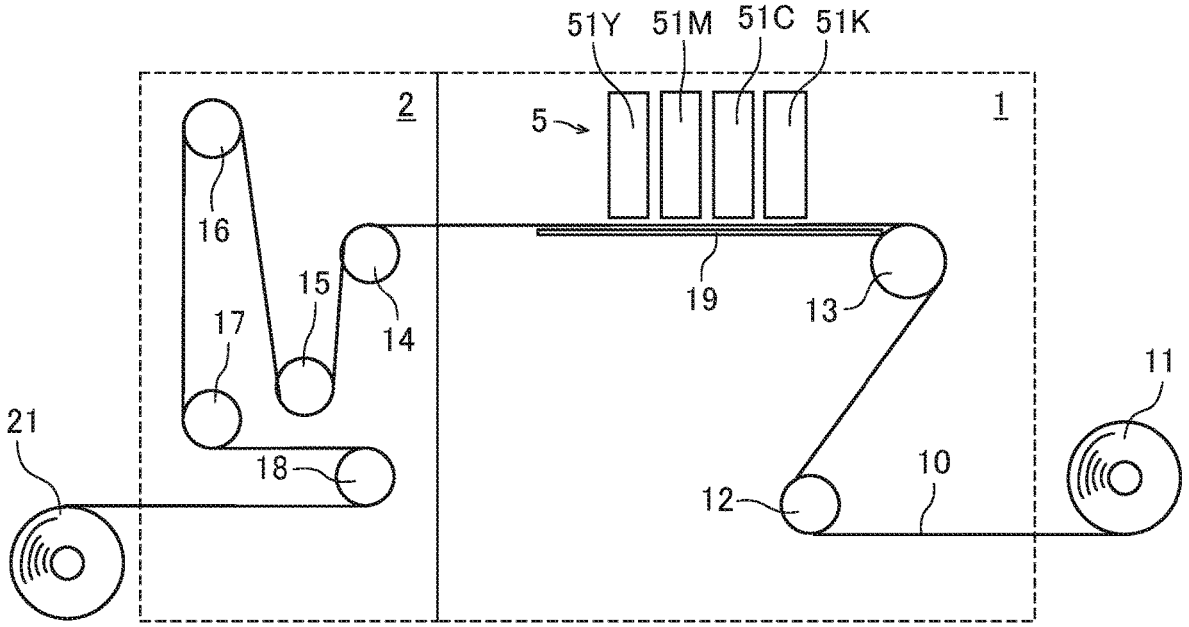
FIG. 1 is a plan view of a mechanism as an example of a liquid discharge apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure will be described with reference to the attached drawings. First, an example of a liquid discharge apparatus according to an embodiment of the present disclosure will be described with reference to FIG. 1. FIG. 1 is a schematic view of the apparatus.

The liquid discharge apparatus includes a full line type head, and has an apparatus main body 1 and an exit unit 2 for earning drying time. The exit unit 2 is on the size of the apparatus main body 1.

In this apparatus, a continuous sheet is used as a medium 10 to which a liquid is to be attached. The medium 10 is unwound from a root winding roller 11, conveyed by conveying rollers 12 to 18, and wound by a winding roller 21. Note that an apparatus to which aspects of the present disclosure are applied may use a sheet-shaped medium.

The medium 10 is conveyed on a conveying guide member 19 facing a liquid discharge unit 5 between the conveying rollers 13 and 14, and an image is formed by a liquid discharged from the liquid discharge unit 5.

Here, the liquid discharge unit 5 has, for example, full line type head units 51D, 51C, 51M, and 51Y for four colors (hereinafter, referred to as "head units 51" unless these units are distinguished from each other depending on a color) arranged from an upstream side in a medium conveying direction. The head units 51 discharge liquids of black (D), cyan (C), magenta (M), and yellow (Y) and apply the liquids onto the medium 10 which is conveyed, respectively. Note that the types and the number of colors are not limited thereto.

Figure 2:
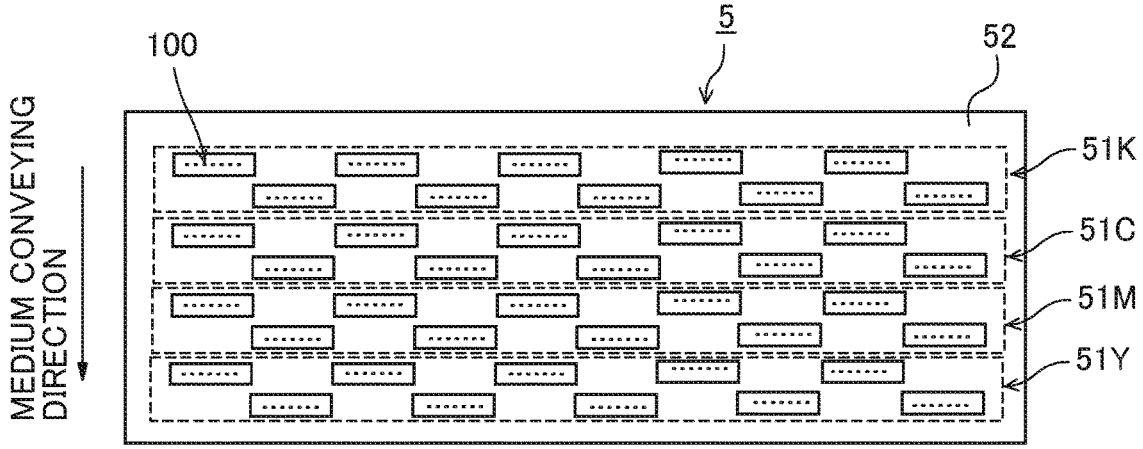
FIG. 2 is a side view of a main part of the mechanism.

For example, as illustrated in FIG. 2, the head unit 51 is formed by arranging a plurality of liquid discharge heads 100 (also simply referred to as "heads") 100 in a staggered pattern on a base member 52 to form a head array. However, the aspects of the present disclosure are not limited thereto. The head unit 51 includes a liquid discharge head and a head tank for supplying a liquid to the liquid discharge head. However, the aspects of the present disclosure are not limited thereto, and the head unit 51 may include the liquid discharge head alone.

Figure 3:
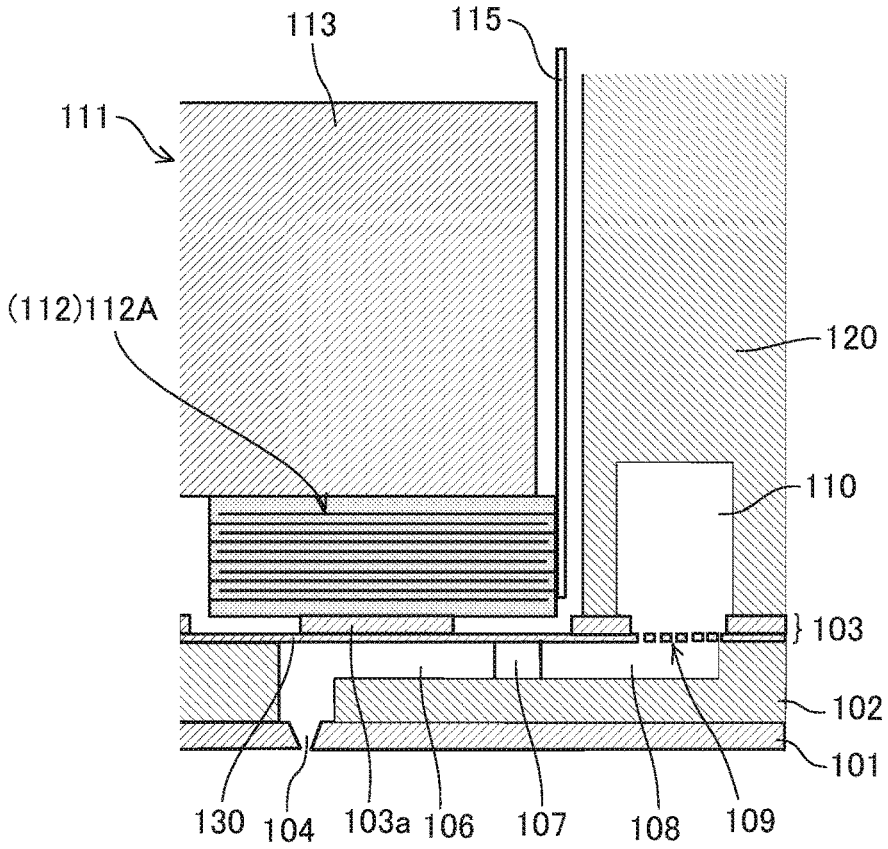
FIG. 3 is a cross-sectional view of an example of a liquid discharge head in a direction orthogonal to a nozzle arrangement direction (liquid chamber longitudinal direction)
Figure 4:
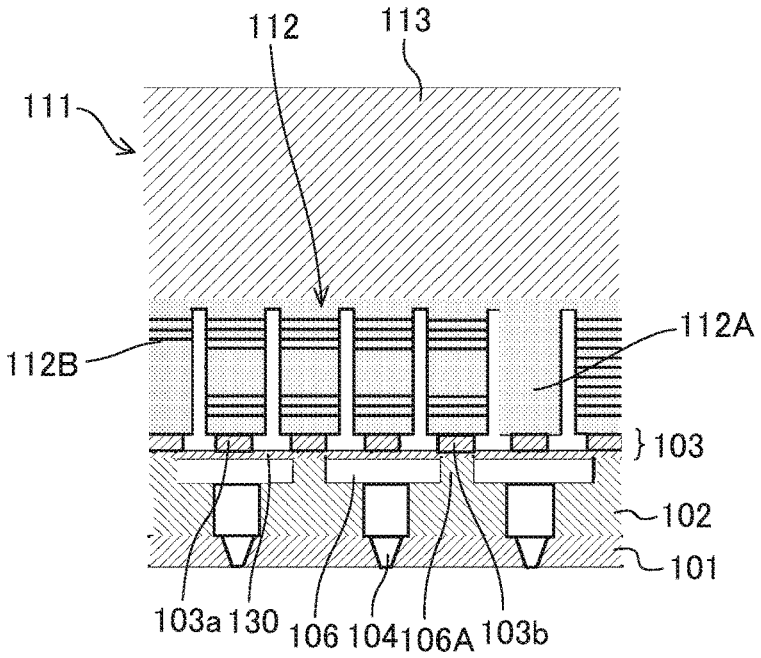
FIG. 4 is a cross-sectional view of the example of the liquid discharge head in the nozzle arrangement direction (liquid chamber short direction)

Next, an example of one liquid discharge head constituting the head unit will be described with reference to FIGS. 3 and 4. FIG. 3 is a cross-sectional view of the head in a direction orthogonal to a nozzle arrangement direction (liquid chamber longitudinal direction), and FIG. 4 is a cross-sectional view of the head in the nozzle arrangement direction (liquid chamber short direction).

In the liquid discharging head, a nozzle plate 101, a channel plate 102, and a diaphragm member 103 are jointed to each other. This liquid discharge head includes a piezoelectric actuator 111 for displacing the diaphragm member 103 and a frame member 120 as a common channel member.

As a result, individual chambers 106 (also referred to as pressure chambers or pressurizing chambers) communicating with a plurality of nozzles 104 for discharging liquid droplets, a liquid supply path 107 for supplying a liquid to the individual chambers 106, serving also as a fluid restrictor, and a liquid introduction unit 108 communicating with the liquid supply path 107 are formed. Adjacent individual chambers 106 are partitioned by a partition wall 106A in the nozzle arrangement direction.

A liquid is supplied from the common liquid chamber 110 as a common channel of the frame member 120 to the plurality of individual chambers 106 via a filter 109 formed in the diaphragm member 103, the liquid introduction unit 108, and the liquid supply path 107.

The piezoelectric actuator 111 is disposed on the opposite side to the individual chamber 106 across a deformable vibration region 130 forming a wall surface of the individual chamber 106 of the diaphragm member 103.

The piezoelectric actuator 111 includes a plurality of laminated piezoelectric members 112 bonded onto a base member 113. In each of the piezoelectric members 112, a piezoelectric element (piezoelectric pillar) 112A serving as a pillar-shaped pressure generation element for applying a drive waveform and a support 112B are formed in a comb shape at predetermined intervals by groove processing using half cut dicing.

The piezoelectric element 112A is bonded to an island-shaped protrusion 103*a* formed in the vibration region 130 of the diaphragm member 103. The support 112B is bonded to the protrusion 103*b* of the diaphragm member 103.

The piezoelectric member 112 is formed by alternately laminating piezoelectric layers and internal electrodes. Each of the internal electrodes is drawn out to an end surface to provide an external electrode. To the external electrode of the piezoelectric element 112A, a flexible printed circuit (FPC) 115 as a flexible wiring board having flexibility is connected for applying a drive waveform.

The frame member 120 includes a common liquid chamber 110 to which a liquid is supplied from a head tank or a liquid cartridge.

In a liquid discharge head having such a configuration, for example, by lowering a voltage applied to the piezoelectric element 112A from an intermediate potential Ve, the piezoelectric element 112A contracts, and the vibration region 130 of the diaphragm member 103 goes down to expand the volume of the individual chamber 106. As a result, liquid flows into the individual chamber 106.

Thereafter, the voltage applied to the piezoelectric element 112A is increased to expand the piezoelectric element 112A in a lamination direction, and the vibration region 130 of the diaphragm member 103 is deformed toward the nozzle 104 to contract the volume of the individual chamber 106. As a result, a liquid in the individual chamber 106 is pressurized, and the liquid is discharged (jetted) from the nozzle 104.

By returning the voltage applied to the piezoelectric element 112A to a reference potential, the vibration region 130 of the diaphragm member 103 is restored to an initial position, and the individual chamber 106 expands to generate a negative pressure. Therefore, the liquid flows from the common liquid chamber 110 into the individual chamber 106 via the liquid supply path 107. Therefore, vibration of a meniscus surface of the nozzle 104 is attenuated and stabilized, and then the process proceeds to operation for next discharge.

Figure 5:
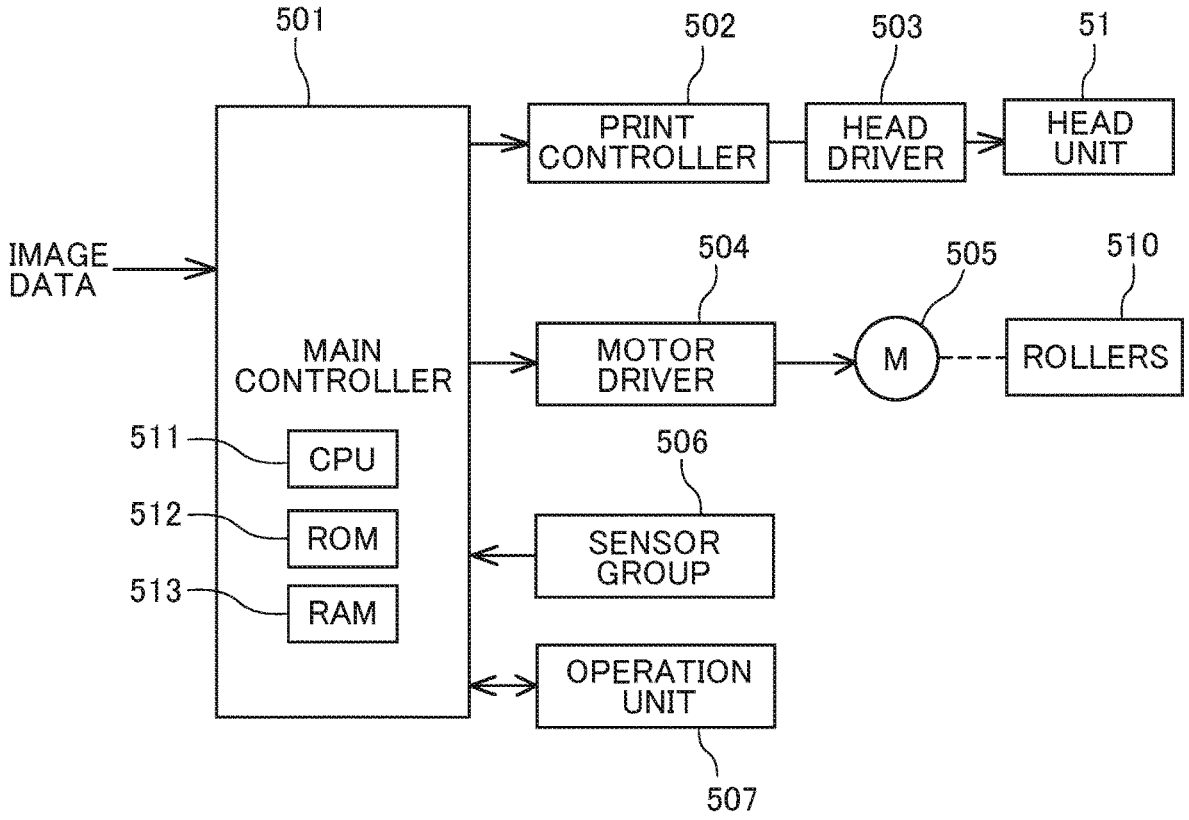
FIG. 5 is a block diagram of a control device of the apparatus.

Next, an outline of a control device of this apparatus will be described with reference to FIG. 5. Note that FIG. 5 is a block diagram of the control device.

The control device includes a main controller 501 (a system controller) constructed of a microcomputer including a central processing unit (CPU) 511 for controlling the entire apparatus, a read-only memory (ROM) 512, a random-access memory (RAM) 513, input/output (I/O), and the like, an image memory, a communication interface, and the like.

The main controller 501 sends print data to a print controller 502 in order to form an image on a medium based on image data transferred from an external information processing apparatus (host side) or the like and various kinds of command information.

The print controller 502 transfers the image data received from the main controller 501 as serial data, and outputs a transfer clock, a latch signal, a control signal, and the like necessary for transfer and transfer confirmation of the image data to a head driver 503.

The print controller 502 includes a drive waveform generator including a digital/analog (D/A) converter for performing D/A conversion of pattern data of a common drive waveform stored in an internal ROM, a voltage amplifier, a current amplifier, and the like, and outputs a common drive waveform constructed of one or more drive pulses (drive signals) to the head driver 503.

The head driver 503 selects a drive pulse constituting a common drive waveform based on image data corresponding to one head unit 51 serially input, and applies the drive pulse to the piezoelectric element 112A as a pressure generation element (unit) to discharge a liquid. At this time, by selecting a part or all of the pulses constituting the common drive waveform or all or a part of waveform elements forming the pulses, dots having different sizes such as large droplets, medium droplets, or small droplets can be given separately.

The main controller 501 controls driving of each of rollers 510 such as the root winding roller 11, the conveying rollers 12 to 18, and the winding roller 21 via a motor driver 504.

To the main controller 501, a detection signal is input from a sensor group 506 including various sensors, and input/output of various kinds of information and exchange of display information are performed between the main controller 501 and an operation unit 507.

Figure 6:
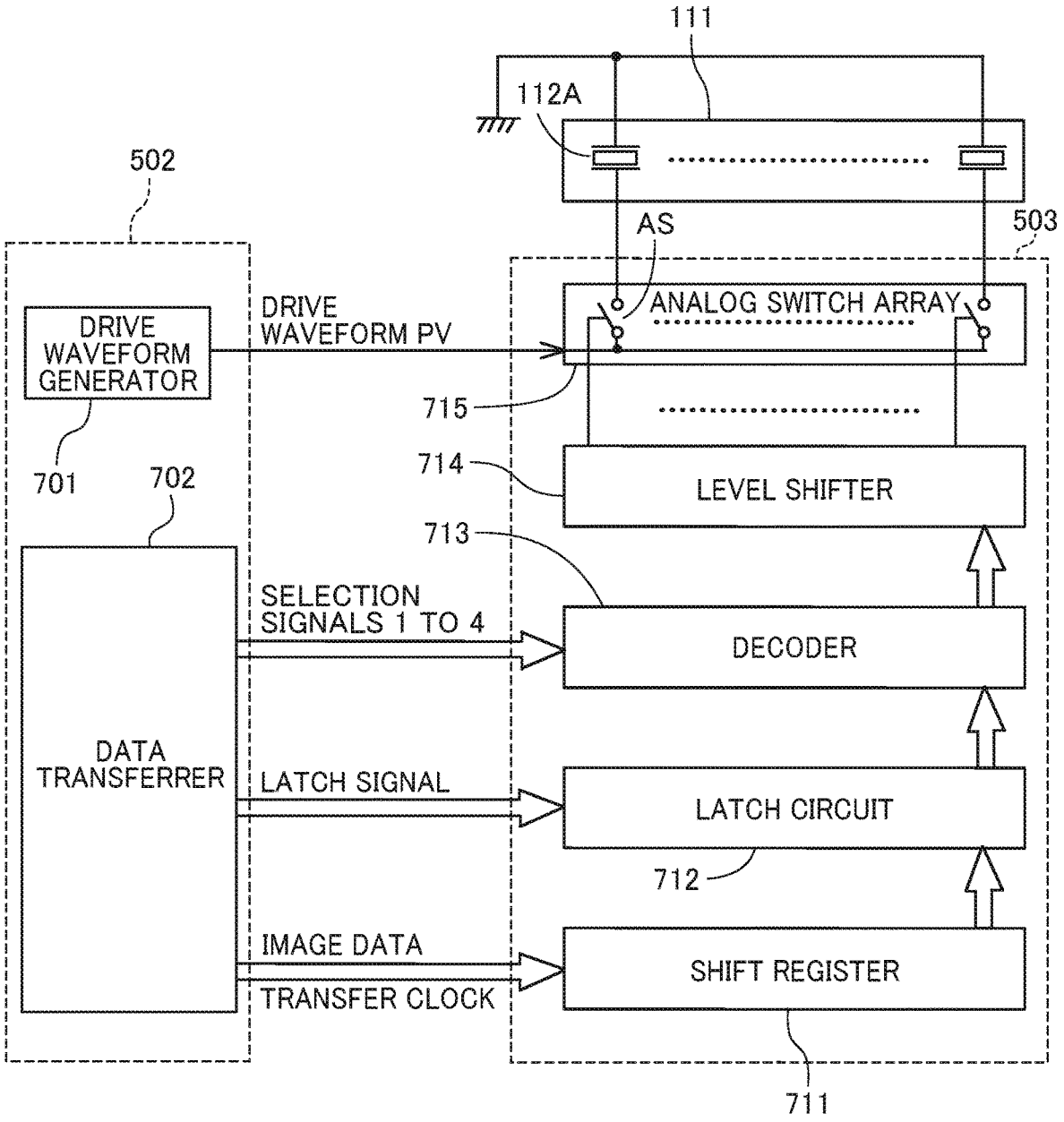
FIG. 6 is a block diagram of an example of a portion related to head drive control.

Next, an example of a portion related to head drive control will be described with reference to the block view of FIG. 6.

The print controller 502 includes a drive waveform generator 701 as a drive waveform generating device according to an embodiment of the present disclosure. The print controller 502 further includes a data transferrer 702 for outputting 2-bit image data (gradation signal 0 or 1) corresponding to a print image and a mask signal (selection signal) MN for selecting a clock signal, a latch signal, or a drive pulse (or a waveform element) constituting a common drive waveform.

Here, from the drive waveform generator 701, a drive waveform Vcom including one or more drive pulses (drive signals) for discharging a liquid is generated and output within one print cycle (one drive cycle).

Note that the mask signal MN is a signal for instructing opening/closing of an analog switch AS which is a switching unit of the head driver 503 for each droplet. A state transition to an H level (ON) occurs with a drive pulse (or waveform element) to be selected in accordance with the print cycle (drive cycle) of the common drive waveform Vcom, and a state transition to an L level (OFF) occurs when selection is not made.

The head driver 503 includes a shift register 711, a latch circuit 712, a decoder 713, a level shifter 714, and an analog switch array 715.

The shift register 711 inputs a transfer clock (shift clock) and serial image data (gradation data: 2 bits/1 channel (1 nozzle)) from the data transferrer 702. The latch circuit 712 latches each register value of the shift register 711 with a latch signal.

The decoder 713 decodes gradation data and a selection signal and outputs the result. The level shifter 714 performs level conversion of a logic level voltage signal of the decoder 713 to a level at which the analog switch AS of the analog switch array 715 can operate.

The analog switch AS of the analog switch array 715 is turned on/off (opened/closed) by output of the decoder 713 applied via the level shifter 714.

The analog switch AS of the analog switch array 715 is connected to an individual electrode of the piezoelectric element 112A, and the common drive waveform Vcom from the drive waveform generator 701 is input thereto. Therefore, the analog switch AS is turned on according to a result of decoding the serially transferred image data (gradation data) and the selection signal MN by the decoder 713. As a result, a required drive pulse (or a waveform element) constituting the common drive waveform Vcom passes (is selected) and applied to an individual electrode of the piezoelectric element 112A.

Figure 7A:
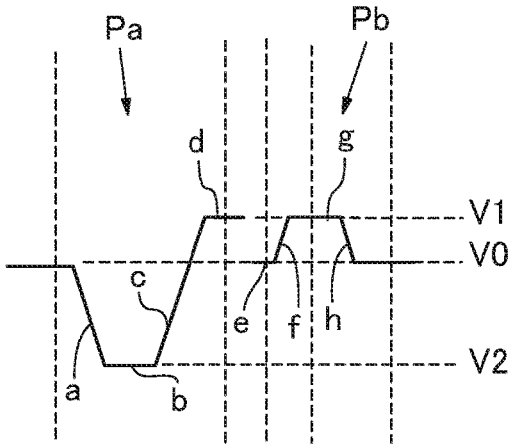
FIGS. 7A to 7C are views for explaining a common drive waveform, a mask signal, a non-discharge drive waveform, and a discharge drive waveform in a first embodiment of the present disclosure.
Figure 7B:
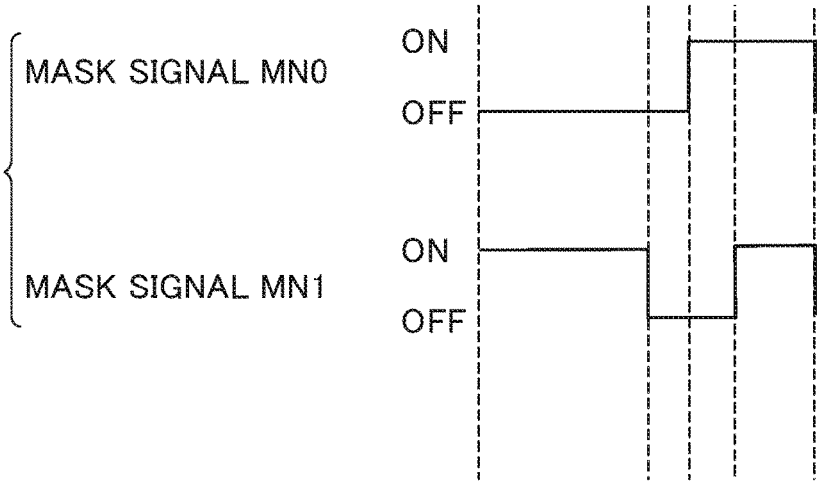
Figure 7C:
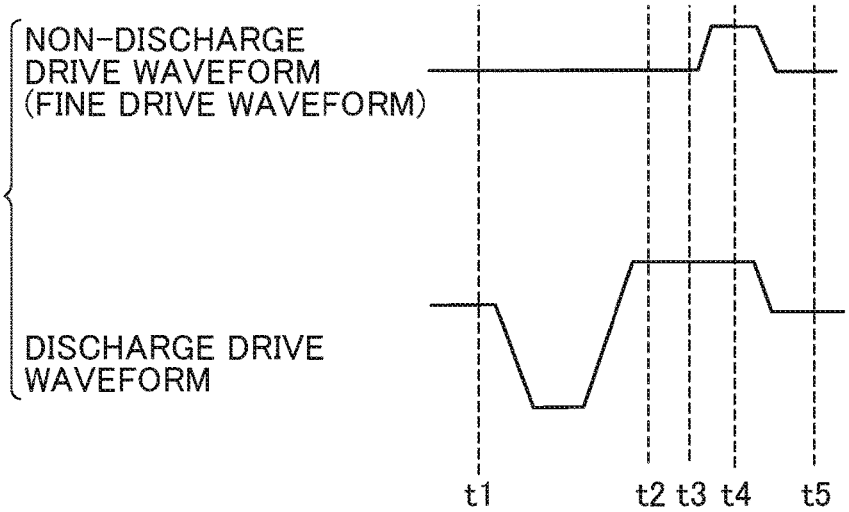

Next, a drive waveform in a first embodiment of the present disclosure will be described with reference to FIGS. 7A to 7C. FIGS. 7A to 7C are views for explaining a common drive waveform, a mask signal, a non-discharge drive waveform, and a discharge drive waveform in the first embodiment.

Note that the "common drive waveform" is a waveform generated by D/A conversion or the like of drive waveform data, the non-discharge drive waveform is a micro-vibration drive waveform to perform drive to such a degree that no liquid is discharged, and the discharge drive waveform is a waveform to discharge a liquid. The "intermediate potential" is "the first voltage in time series in the drive waveform of one cycle".

First, as illustrated in FIG. 7A, the common drive waveform Vcom includes a discharge pulse Pa as a drive pulse which is a first waveform and continuous in time series and a non-discharge pulse Pb (micro vibrating pulse) as a drive pulse which is a second waveform.

The discharge pulse Pa as the first waveform is a waveform in which the potential falls from an intermediate potential V0, then rises to a potential V1 higher than the intermediate potential, and is held at the potential V1.

This discharge pulse P1 includes a falling waveform element a, a holding waveform element b, a raising waveform element c, and a holding waveform element d. The falling waveform element a is a waveform element for expanding the individual chamber 106 and is also referred to as a drawing-in waveform element or an expansion waveform element. The raising waveform element c is a waveform element for contracting the individual chamber 106 and is also referred to as a contraction waveform element or a push-in waveform element.

The falling waveform element a lowers the potential from the intermediate potential V0 to a potential V2 lower than the intermediate potential V0 (V2<V0) to expand the individual chamber 106. The holding waveform element b holds the falling potential V2 by the falling waveform element a for a certain period of time. The raising waveform element c raises the potential from the potential V2 held by the holding waveform element b to the potential V1 higher than the intermediate potential V0 to contract the individual chamber 106 to discharge a liquid.

The non-discharge pulse Pb as the second waveform is a waveform which is discontinuous with a waveform element holding the potential of the discharge pulse Pa as the first waveform and in which the potential rises from the intermediate potential V0 to the potential V1 higher than the intermediate potential V0, is held at the potential V1 for a predetermined time, and then falls to the intermediate potential V0. Although the non-discharge pulse Pb is discontinuous with the waveform element of the discharge pulse Pa, for example, the duration between the time points t2 and t3 is short so that the non-discharge pulse Pb is continuous in time series with the discharge pulse Pa.

The non-discharge pulse P2 includes a holding waveform element e holding the intermediate potential V0, a raising waveform element f that raises the potential from the intermediate potential V0 held by the holding waveform element e to the potential V1, a holding waveform element g holding the potential V1, and a raising waveform element h that lowers the potential from the potential V1 held by the holding waveform element g to the intermediate potential V0. At this time, the piezoelectric element 112A is driven by the non-discharge pulse Pb to such a degree that a meniscus sways, and no liquid is discharged (micro vibration driving or non-discharge driving).

Next, as illustrated in FIG. 7B, a mask signal (selection signal) MN0 is a signal to be turned on at the time point t3 and kept on to the time point t5. Therefore, when the mask signal MN0 is applied, the waveform element of the non-discharge pulse Pb is selected, and the other waveform elements are masked.

As a result, as illustrated in FIG. 7C, the non-discharge pulse P2 is applied to the piezoelectric element 112A as a non-discharge drive waveform (micro-vibration drive waveform). The non-discharge drive waveform contracts the individual chamber 106 to perform micro vibration driving.

As illustrated in FIG. 7B, a mask signal MN1 is a signal to be turned on from the time point t1 to the time point t2, to be turned off from the time point t2 to the time point t4, to be turned on again at the time point t4, and to be turned off at the time point t5.

As a result, as illustrated in FIG. 7C, a discharge drive waveform constructed of the waveform elements of the discharge pulse Pa and the non-discharge pulse Pb are applied to a piezoelectric element 112A.

That is, the falling waveform element a, the holding waveform element b, and the raising waveform element c of the discharge pulse Pa are applied, and a liquid is thereby discharged (discharge driving). The holding waveform element d of the discharge pulse Pa is applied to the piezoelectric element 112A, and then a drive waveform applied to the piezoelectric element 112A is interrupted. The piezoelectric element 112A holds the potential V1 when the drive waveform is interrupted.

Thereafter, the holding waveform element g of the non-discharge pulse Pb is selected, and the non-discharge pulse Pb is applied to the piezoelectric element 112A until the time point t5. Therefore, the potential V1 is again applied to the piezoelectric element 112A.

Here, the holding waveform element d holding the potential V1 of the discharge pulse Pa is for performing damping after discharge of a liquid by the raising waveform element c or shortening satellite droplets. Even when application of the holding waveform element d is interrupted, the potential V1 is held, and the potential V1 is applied again by the holding waveform element g of the non-discharge pulse Pb. Therefore, the potential V1 can be held for a predetermined time, enabling damping after discharge of liquid or shortening of satellite droplets.

That is, in the present embodiment, the non-discharge pulse Pb is embedded in the waveform element for damping of the discharge pulse Pa or shortening of satellite droplets. At this time, time during which the drive waveform is interrupted by a damping waveform element is short, an influence of free discharge of a piezoelectric element can be relaxed, and stable drive can be performed. It is not necessary to increase the length of a waveform because of micro vibration driving. Therefore, high frequency drive can be achieved.

Figure 8A:
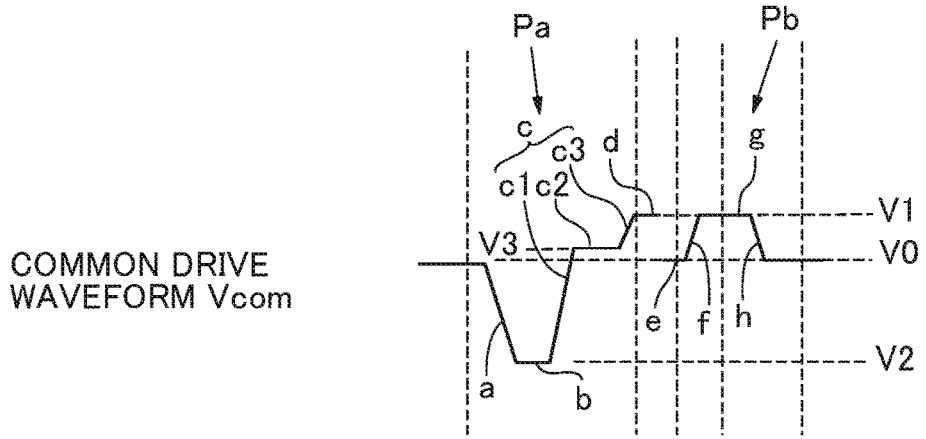
FIGS. 8A to 8C are views for explaining a common drive waveform, a selection signal (mask signal), a non-discharge drive waveform, and a discharge drive waveform in a second embodiment of the present disclosure.
Figure 8B:
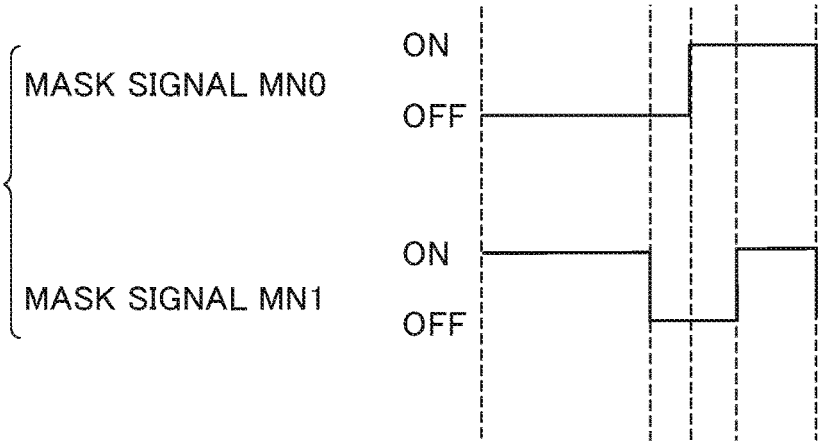
Figure 8C:
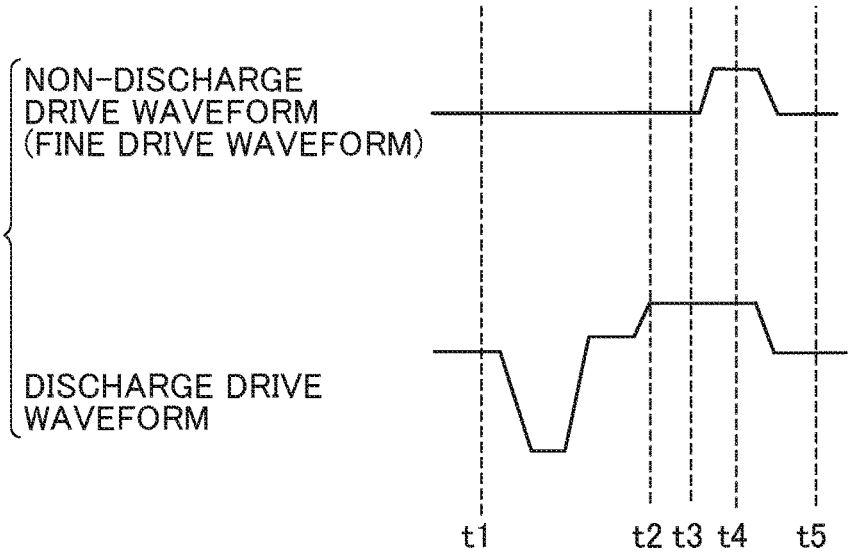

Next, a drive waveform in a second embodiment of the present disclosure will be described with reference to FIGS. 8A to 8C. FIGS. 8A to 8C are views for explaining a common drive waveform, a selection signal (mask signal), a non-discharge drive waveform, and a discharge drive waveform in the second embodiment.

In the present embodiment, a waveform element c that raises the potential from the falling potential V2 of the discharge pulse Pa to the raised potential V1 includes a first raising waveform element c1 that raises the potential from the potential V2 to a potential V3 higher than the intermediate potential V0 and lower than the potential V1 (V0<V3<V1) to discharge a liquid, a holding waveform element c2 holding the potential V3, and a second raising waveform element c3 that raises the potential from the potential V3 to the potential V1. Thus, with the waveform element c, the potential changes and rises stepwise. The potential V1 that has risen with the second raising waveform element c3 is held by a holding waveform element d.

At this time, a liquid is discharged by the first raising waveform element c1, and the potential is held by the holding waveform element i for a predetermined time. Thereafter, the individual chamber 106 is contracted again by the second raising waveform element c3. In this manner, extrusion is performed in two stages after discharging a liquid, which facilitates damping or enables satellite shortening as compared with the drive waveform of the first embodiment. As in the first embodiment, by commonly using a damping waveform element for micro vibration driving from the middle, it is not necessary to increase the length of a waveform for micro vibration driving, and high frequency drive can be achieved.

Figure 9A:
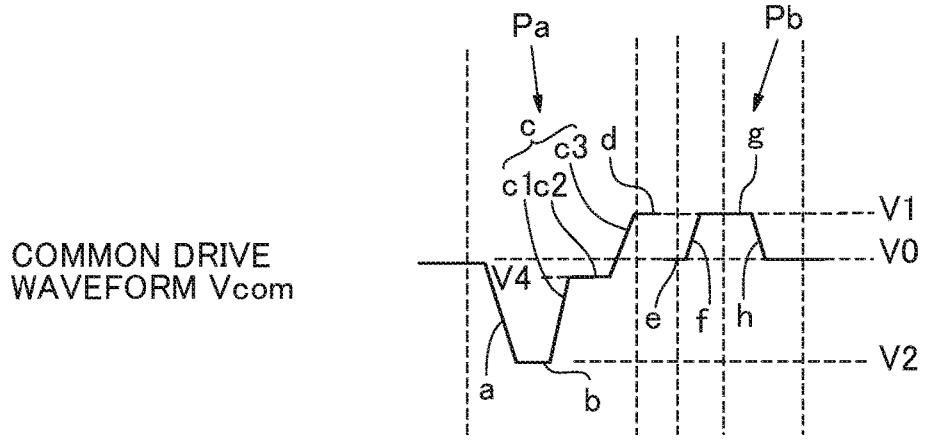
FIGS. 9A to 9C are views for explaining a common drive waveform, a selection signal (mask signal), a non-discharge drive waveform, and a discharge drive waveform in a third embodiment of the present disclosure.
Figure 9B:
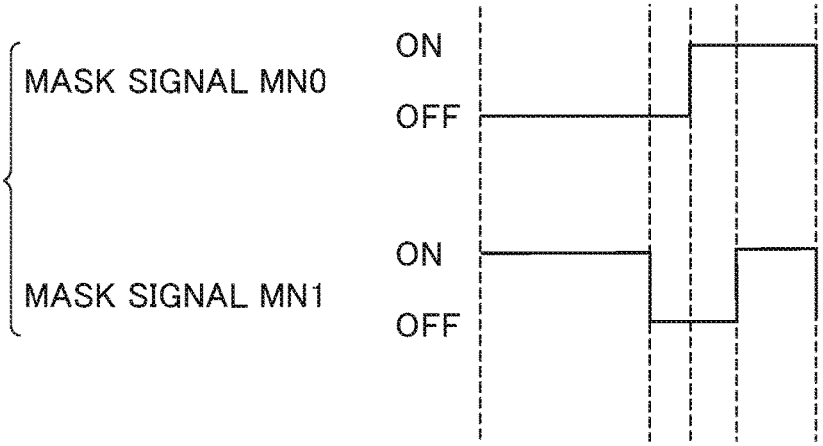
Figure 9C:
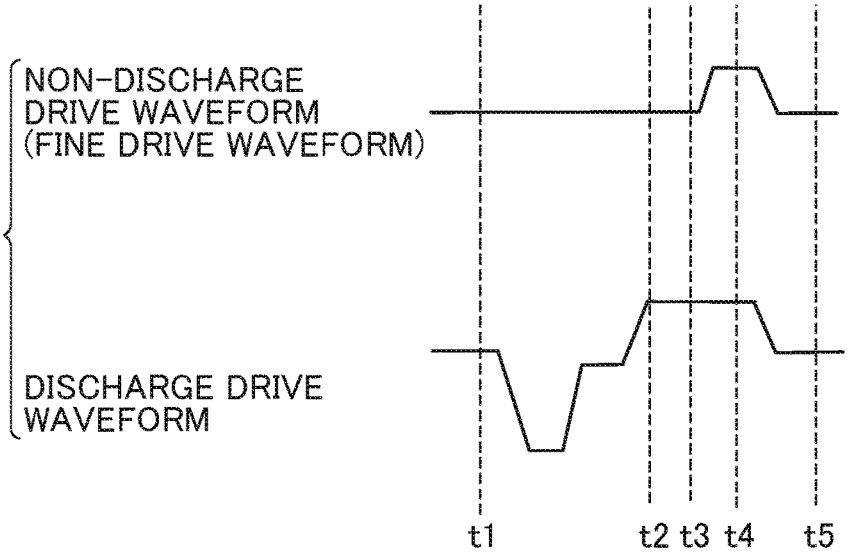

Next, a drive waveform in a third embodiment of the present disclosure will be described with reference to FIGS. 9A to 9C. FIGS. 9A to 9C are views for explaining a common drive waveform, a selection signal (mask signal), a non-discharge drive waveform, and a discharge drive waveform in the third embodiment.

In the present embodiment, the raised potential of the first raising waveform element c1 of the discharge pulse Pa of the second embodiment is set to a potential V4 lower than the intermediate potential V0 (V4<V0).

Such setting enables a reduction in droplet size at the same discharge speed as compared with the second embodiment.

Figure 10A:
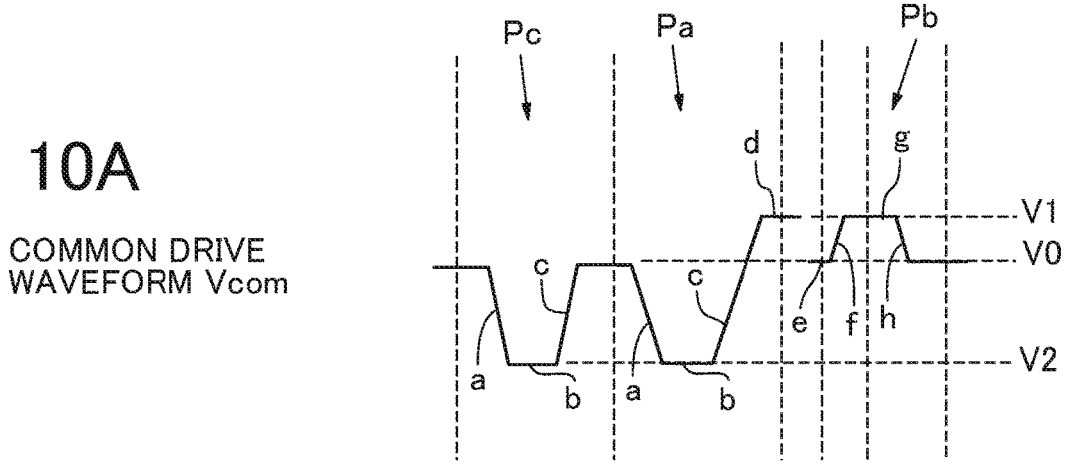
FIGS. 10A to 10C are views for explaining a common drive waveform, a selection signal (mask signal), a non-discharge drive waveform, and a discharge drive waveform in a fourth embodiment of the present disclosure.
Figure 10B:
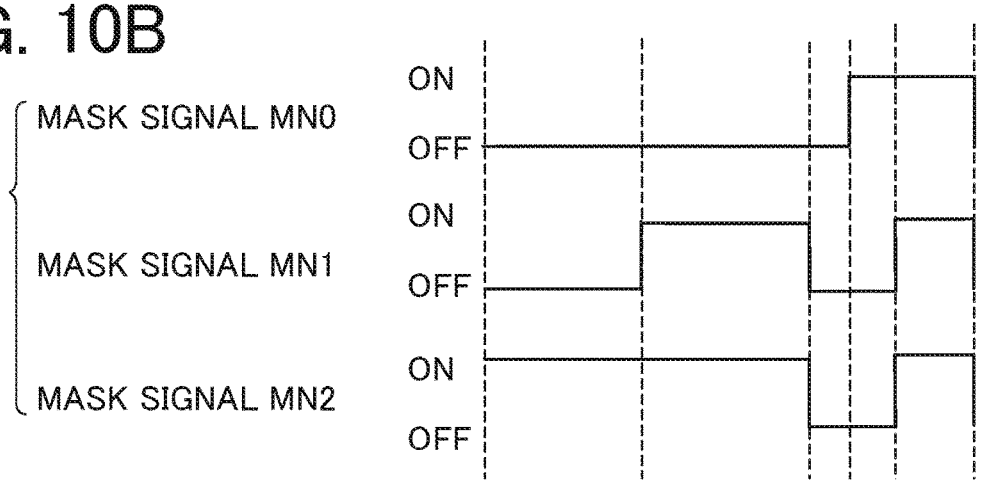
Figure 10C:
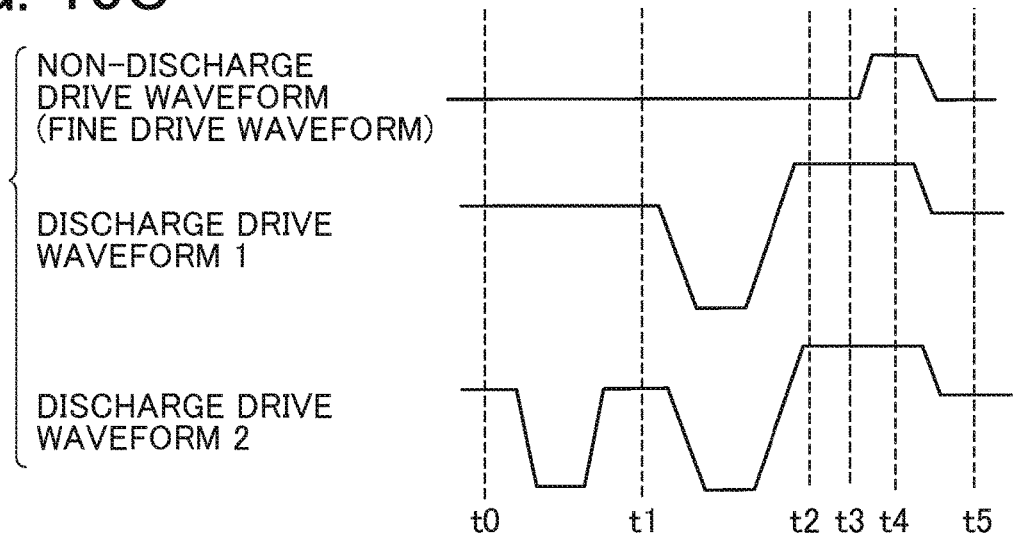

Next, a drive waveform in a fourth embodiment of the present disclosure will be described with reference to FIGS. 10A to 10C. FIGS. 10A to 10C are views for explaining a common drive waveform, a selection signal (mask signal), a non-discharge drive waveform, and a discharge drive waveform in the fourth embodiment.

The common drive waveform Vcom according to the present embodiment includes, before the discharge pulse Pa, a discharge pulse Pc as a third waveform. In the discharge pulse Pc, the potential falls from the intermediate potential V0 to the potential V2 with a falling waveform element a, the potential is kept at the potential V2 with a holding waveform element b, and then the potential rises to the intermediate potential V0 with a raising waveform element c. The discharge pulse Pc is a waveform for discharging a liquid.

Meanwhile, as mask signals MN, together with a mask signal MN0 for selecting the non-discharge pulse Pb and a mask signal MN1 for selecting the discharge pulse Pa and the non-discharge pulse Pb, a mask signal MN2 for selecting both the discharge pulses Pc and Pa and the non-discharge pulse Pb is set.

By selecting the discharge pulses Pc and Pa, two droplets are discharged, and the amount of liquid adhering can be increased to increase image density. Discharging one droplet with the discharge pulse Pa is advantageous in smoothing image graininess and a gradation change in image density.

Figure 11A:
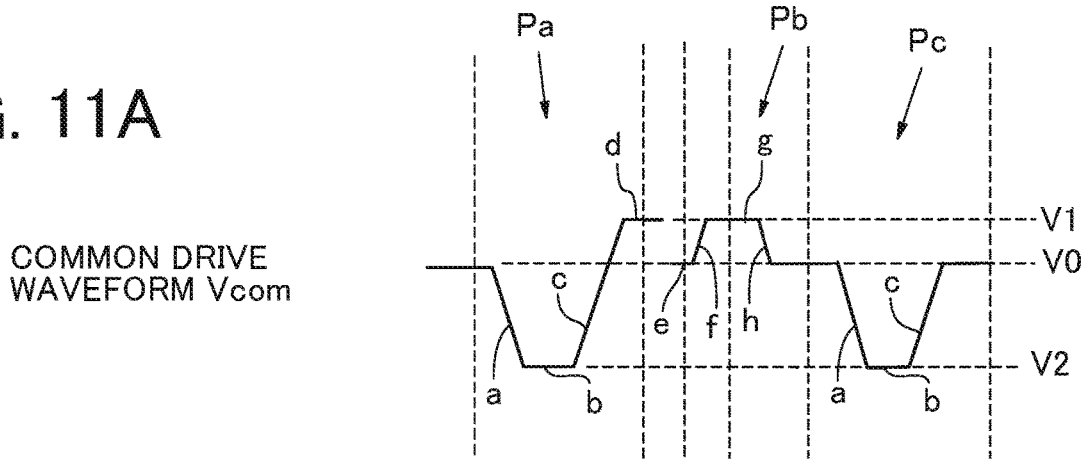
FIGS. 11A to 11C are views for explaining a common drive waveform, a selection signal (mask signal), a non-discharge drive waveform, and a discharge drive waveform in a fifth embodiment of the present disclosure.
Figure 11B:
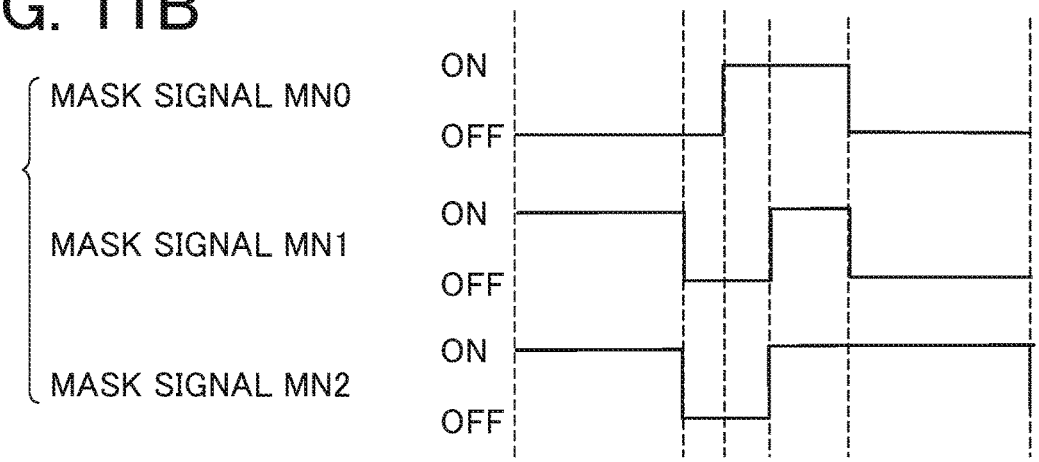
Figure 11C:
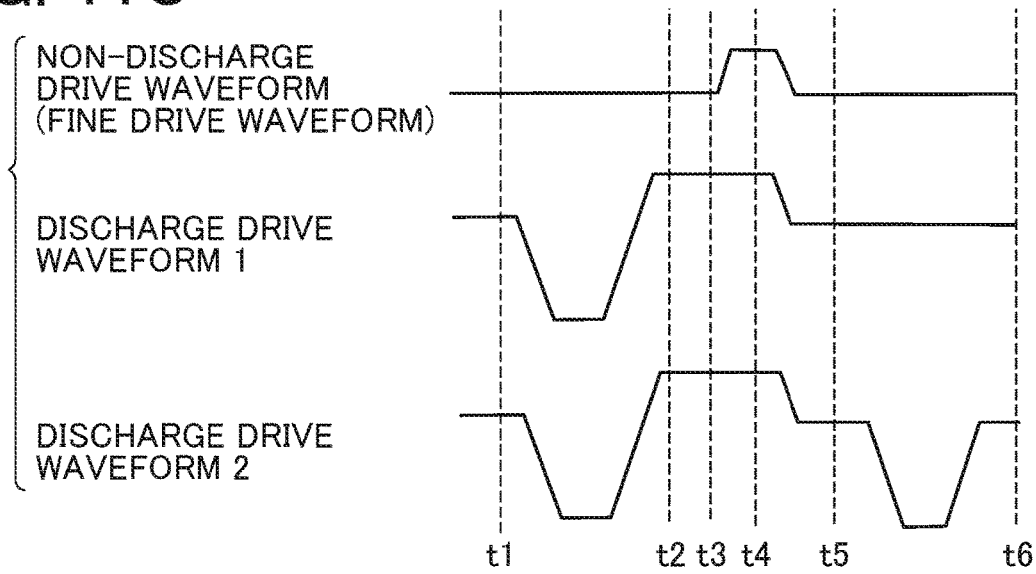

Next, a drive waveform in a fifth embodiment of the present disclosure will be described with reference to FIGS. 11A to 11C FIGS. 11A to 11C are views for explaining a common drive waveform, a selection signal (mask signal), a non-discharge drive waveform, and a discharge drive waveform in the fifth embodiment.

The common drive waveform Vcom according to the present embodiment includes, after the non-discharge pulse Pb, a discharge pulse Pc as a third waveform. In the discharge pulse Pc, the potential falls from the intermediate potential V0 to the potential V2 with a falling waveform element a, the potential is kept at the potential V2 with a holding waveform element b, and then the potential rises to the intermediate potential V0 with a raising waveform element c. The discharge pulse Pc is a waveform for discharging a liquid.

Meanwhile, as mask signals MN, together with a mask signal MN0 for selecting the non-discharge pulse Pb and a mask signal MN1 for selecting the discharge pulse Pa and the non-discharge pulse Pb, a mask signal MN2 for selecting both the discharge pulses Pc and Pa and the non-discharge pulse Pb is set.

By selecting the discharge pulses Pc and Pa, two droplets are discharged, and the amount of liquid adhering can be increased to increase image density. By discharging one droplet by the discharge pulse Pa, it is possible to smooth image graininess and a gradation change in image density.

Figure 12A:
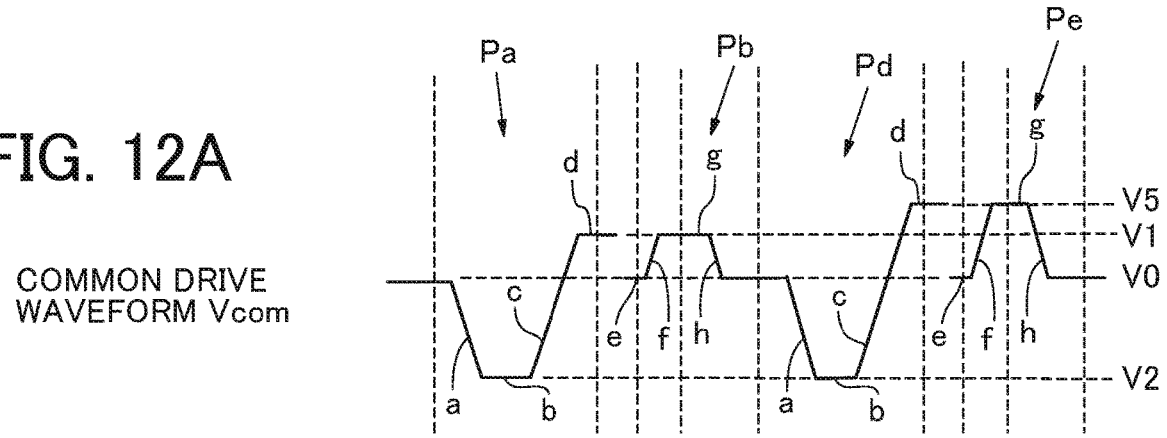
FIGS. 12A to 12C are views for explaining a common drive waveform, a selection signal (mask signal), a non-discharge drive waveform, and a discharge drive waveform in a sixth embodiment of the present disclosure.
Figure 12B:
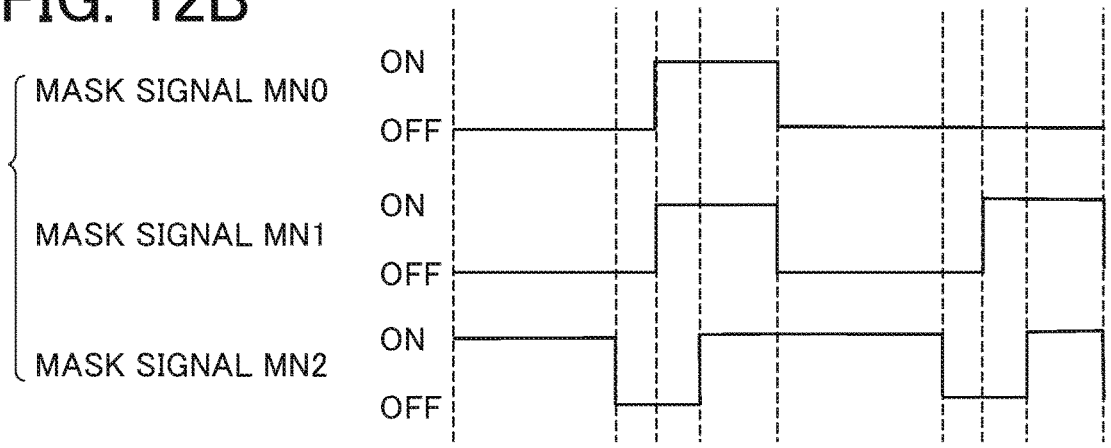
Figure 12C:
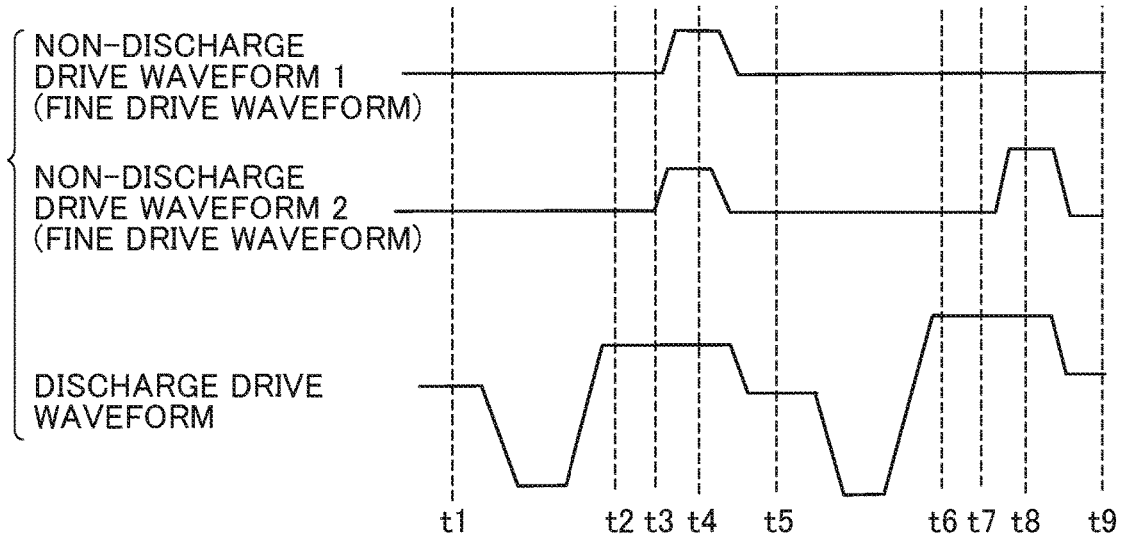

Next, a sixth embodiment of the present disclosure will be described with reference to FIGS. 12A to 12C. FIGS. 12A to 12C are views for explaining a common drive waveform, a selection signal (mask signal), a non-discharge drive waveform, and a discharge drive waveform in the sixth embodiment.

In addition to the discharge pulse Pa and the non-discharge pulse Pb, the common drive waveform Vcom according to the present embodiment includes a discharge pulse Pd and a non-discharge pulse Pe.

The discharge pulse Pd as a first waveform is a waveform in which the potential falls from the intermediate potential V0, then rises to a potential V5 higher than the intermediate potential, and is held at the potential V5.

The discharge pulse Pd includes the falling waveform element a, the holding waveform element b, the raising waveform element c, and the holding waveform element d. The falling waveform element a expands the individual chamber 106.

The falling waveform element a lowers the potential from the intermediate potential V0 to a potential V2 lower than the intermediate potential V0 (V2<V0) to expand the individual chamber 106. The holding waveform element b holds the falling potential V2 by the falling waveform element a for a certain period of time. The raising waveform element c raises the potential from the potential V2 held by the holding waveform element b to the potential V5 higher than the intermediate potential V0 to contract the individual chamber 106 to discharge a liquid.

The non-discharge pulse Pe is a waveform which is discontinuous with the holding waveform element d holding the potential of the discharge pulse Pd and in which the potential rises from the intermediate potential V0 to the potential V5 higher than the intermediate potential V0, is held at the potential V5, and then falls to the intermediate potential V0.

The non-discharge pulse Pe includes a holding waveform element e holding the intermediate potential V0, a raising waveform element f that raises the potential from the intermediate potential V0 held by the holding waveform element e to the potential V5, a holding waveform element g holding the potential V5, and a raising waveform element h that lowers the potential from the potential V5 held by the holding waveform element g to the intermediate potential V0. At this time, the piezoelectric element 112A is driven by the non-discharge pulse Pb to such a degree that a meniscus sways, and no liquid is discharged (micro vibration driving).

Next, a mask signal MN0 is similar to the mask signal MN0 of the first embodiment. A mask signal MN1 is turned on from the time point t3 to the time point t5, and is turned on from the time point t6 to the time point t8. By applying the mask signal MN1, the non-discharge pulses Pb and Pe are selected.

A mask signal MN2 is turned on from the time point t1 to the time point t2, turned off from the time point t2 to the time point t4, turned on from the time point t4 to the time point t6, and turned off from the time point t6 to the time point t8.

By applying the mask signal MN2, as in the first embodiment, after the halfway of the holding waveform element d of the discharge pulse Pa is applied, the drive waveform to the piezoelectric element 112A is interrupted, and the non-discharge pulse Pb is selected from the middle of the holding waveform element g of the non-discharge pulses Pb to the time point t5. Similarly, after the halfway of the holding waveform element d of the discharge pulse Pd is applied, the drive waveform to the piezoelectric element 112A is interrupted, and the non-discharge pulse Pe is selected from the middle of the holding waveform element g of the non-discharge pulses Pe to the time point t9.

As described above, the present embodiment enables selective use of micro vibration driving by one non-discharge pulse Pb and micro vibration driving by two non-discharge pulses Pb and Pd (two second waveforms). As a result, these can be selectively used, for example, in a case where standing time is different or in a case where the pigment size in a liquid is different.

Figure 13A:
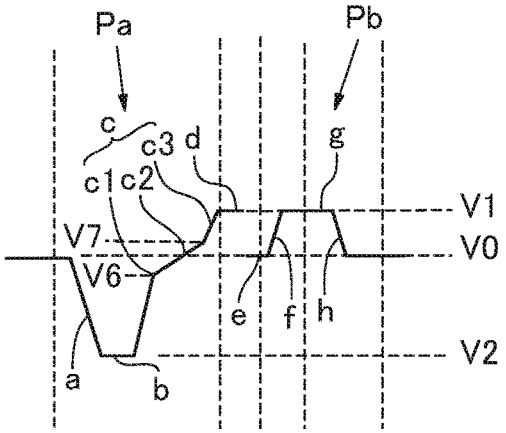
FIGS. 13A to 13C are views for explaining a common drive waveform, a selection signal (mask signal), a non-discharge drive waveform, and a discharge drive waveform in a seventh embodiment of the present disclosure.
Figure 13B:
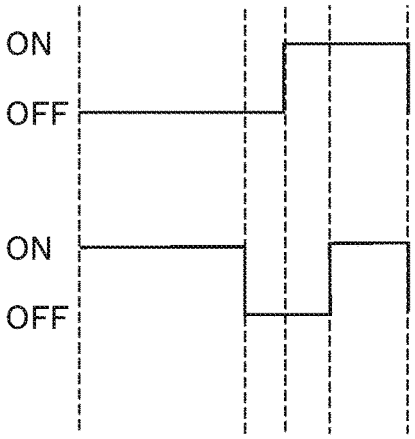
Figure 13C:
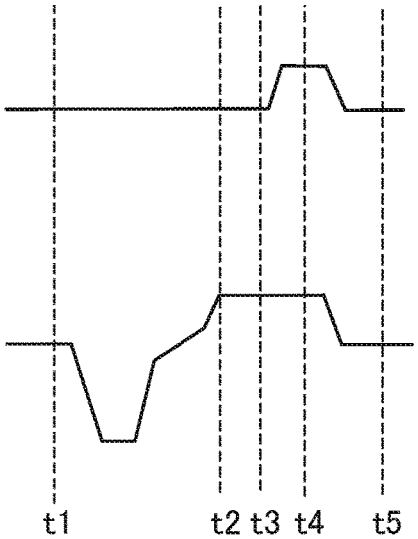

Next, a seventh embodiment of the present disclosure will be described with reference to FIGS. 13A to 13C. FIGS. 13A to 13C are views for explaining a common drive waveform, a selection signal (mask signal), a non-discharge drive waveform, and a discharge drive waveform in the seventh embodiment.

In the present embodiment, a raising waveform element of the discharge pulse Pa includes a first raising waveform element c1 in which the potential rises from the potential V2 to a potential V6 (V6<V0), a second raising waveform element c2 in which the potential rises from the potential V6 to a potential V7 (V1>V7>V0) at an inclination (potential change rate) different from that of the first raising waveform element c1, and a third raising waveform element c3 in which the potential rises from the potential V7 to the potential V1.

As described above, the potential change rate per unit time is different in continuous raising waveform element s. By further performing contraction (extrusion) with a plurality of raising waveform element s, meniscus vibration caused by extrusion can be smaller than the waveform of the third embodiment, and discharge stability can be improved even with a liquid having a low viscosity.

In the present application, a liquid to be discharged may be any liquid as long as having a viscosity and surface tension that can be discharged from a head, and is not particularly limited, but preferably has a viscosity of 30 mPa·s or less at ordinary temperature and normal pressure or by heating or cooling. More specifically, the liquid to be discharged is a solution, a suspension liquid, an emulsion, or the like containing a solvent such as water or an organic solvent, a colorant such as a dye or a pigment, a function-imparting material such as a polymerizable compound, a resin, or a surfactant, a biocompatible material such as deoxyribonucleic acid (DNA), amino acid, protein, or calcium, or an edible material such as a natural pigment, which can be used, for example, for an inkjet ink, a surface treatment liquid, a liquid for forming a constituent element of an electronic element or a light emitting element or an electronic circuit resist pattern, a three-dimensional modeling material liquid, or the like.

Examples of an energy generation source for discharging a liquid include those using a piezoelectric actuator (a laminated type piezoelectric element and a thin film type piezoelectric element), a thermal actuator using an electrothermal transducer such as a heating resistor, and an electrostatic actuator including a diaphragm and a counter electrode.

The "liquid discharge apparatus" includes not only an apparatus capable of discharging a liquid onto a liquid-attachable object but also an apparatus for discharging a liquid toward a gas or a liquid.

The "liquid discharge apparatus" may also include a unit related to feeding, conveying, or sheet ejection of a liquid-attachable object, a pretreatment device, a post-treatment device, and the like.

Examples of the "liquid discharge apparatus" include an image forming apparatus for discharging an ink to form an image on a sheet and a stereoscopic modeling apparatus (three-dimensional modeling apparatus) for discharging a modeling liquid onto a powder layer obtained by forming a powder into a layer shape in order to model a stereoscopic modeled object (three-dimensional modeled object).

The "liquid discharge apparatus" is not limited to an apparatus in which a significant image such as a letter or a graphic is visualized by a discharged liquid. Examples of the "liquid discharge apparatus" include an apparatus for forming a pattern or the like having no meaning by itself and an apparatus for modeling a three-dimensional image.

The "liquid-attachable object" means an object to which a liquid can be attached at least temporarily, and means an object causing adhesion by attachment, an object causing permeation by attachment, or the like. Specific examples of the "liquid-attachable object" include a recording medium such as a sheet, recording paper, a recording sheet, a film, or a cloth, an electronic component such as an electronic substrate or a piezoelectric element, and a medium such as a powder layer (powdery layer), an organ model, or an inspection cell. Unless particularly limited, the "liquid-attachable object" includes everything to which a liquid is attached.

A material of the "liquid-attachable object" may be any material as long as a liquid can be attached to the object even temporarily, such as paper, yarn, fiber, cloth, leather, metal, plastic, glass, wood, or ceramics.

The "liquid discharge apparatus" includes an apparatus in which a liquid discharge head and a liquid-attachable object move relatively to each other, but is not limited thereto. Specific examples thereof include a serial type apparatus for moving a liquid discharge head and a line type apparatus for not moving a liquid discharge head.

Examples of the "liquid discharge apparatus" further include a treatment liquid application apparatus for discharging a treatment liquid onto a sheet in order to apply the treatment liquid to a surface of the sheet, for example, in order to modify the surface of the sheet, and a spraying granulation apparatus for spraying a composition liquid in which a raw material is dispersed in a solution via a nozzle to granulate fine particles of the raw material.

In the terms of the present application, image formation, recording, letter printing, photograph printing, printing, modeling, and the like are all synonymous.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A drive waveform generating device comprising:

circuitry configured to, generate a drive waveform including a first waveform and a second waveform continuous in time series with the first waveform such that, the first waveform includes a falling element, a raising element and a potential holding element, the falling element lowering a potential from an intermediate potential to a lower potential lower than the intermediate potential the raising element raising the potential from the lower potential to a higher potential higher than the intermediate potential and the potential holding element holding the higher potential, and the second waveform includes a raising element, a potential holding element and a falling element, the raising element raising the potential from the intermediate potential to a raised potential higher than the intermediate potential the potential holding element holding the raised potential and the falling element lowering the potential from the raised potential to the intermediate potential; and drive a liquid discharge head to discharge a liquid by performing a first input operation to input the first waveform to a pressure generation element of the liquid discharge head such the input operation of the first waveform to the pressure generation element is interrupted while the higher potential is held in the first waveform, and performing a second input operation to input the second waveform to the pressure generation element while the raised potential is held in the second waveform.

2. The drive waveform generating device according to claim 1, wherein, with the raising element of the first waveform, the potential rises stepwise from the lower potential to the higher potential.

3. The drive waveform generating device according to claim 1, wherein the raising element of the first waveform includes at least two waveform elements different in potential change rate from each other.

4. The drive waveform generating device according to claim 1, wherein the drive waveform further includes a third waveform different from the first waveform and the second waveform, the third waveform in which the potential falls from the intermediate potential and rises to the intermediate potential or higher than the intermediate potential.

5. The drive waveform generating device according to claim 1, wherein the drive waveform further includes at least one additional second waveform.

6. The drive waveform generating device according to claim 1, wherein, to drive the liquid discharge head not to discharge the liquid, the circuitry is configured to input the second waveform to the pressure generation element.

7. A liquid discharge apparatus comprising:

a liquid discharge head including, a nozzle configured to discharge a liquid, and a pressure generation element configured to generate a pressure to discharge the liquid from the nozzle based on a drive waveform; and a drive waveform generating device including circuitry configured to, generate the drive waveform including a first waveform and a second waveform continuous in time series with the first waveform such that the first waveform includes a falling element, a raising element and a potential holding element, the falling element lowering a potential from an intermediate potential to a lower potential lower than the intermediate potential, the raising element raising the potential from the lower potential to a higher potential higher than the intermediate potential and the potential holding element holding the higher potential, and the second waveform includes a raising element, a potential holding element and a falling element, the raising element raising the potential from the intermediate potential to a raised potential higher than the intermediate potential, the potential holding element holding the raised potential and the falling element lowering the potential from the raised potential to the intermediate potential, and drive the liquid discharge head to discharge the liquid by performing a first input operation to input the first waveform to the pressure generation element such the input operation of the first waveform to the pressure generation element is interrupted while the higher potential is held in the first waveform, and performing a second input operation to input the second waveform to the pressure generation element while the raised potential is held in the second waveform.

8. The liquid discharge apparatus according to claim 7, wherein, to drive the liquid discharge head not to discharge the liquid, the circuitry is configured to input the second waveform to the pressure generation element.

9. The liquid discharge apparatus according to claim 7, wherein, with the raising element of the first waveform, the potential rises stepwise from the lower potential to the higher potential.

10. The liquid discharge apparatus according to claim 7, wherein the raising element of the first waveform includes at least two waveform elements different in potential change rate from each other.

11. The liquid discharge apparatus according to claim 7, wherein the drive waveform further includes a third waveform different from the first waveform and the second waveform, the third waveform in which the potential falls from the intermediate potential and rises to the intermediate potential or higher than the intermediate potential.

12. The liquid discharge apparatus according to claim 7, wherein the drive waveform further includes at least one additional second waveform.

13. A method for driving a liquid discharge head, the method comprising:

generating a drive waveform including a first waveform and a second waveform such that, the first waveform includes a falling element, a raising element and a potential holding element, the falling element lowering a potential from an intermediate potential to a lower potential lower than the intermediate potential, the raising element raising the potential from the lower potential to a higher potential higher than the intermediate potential and the potential holding element holding the higher potential, and the second waveform is discontinuous with the potential holding element of the first waveform, and the second waveform includes a raising element, a potential holding element and a falling element, the raising element raising the potential from the intermediate potential to a raised potential higher than the intermediate potential the potential holding element holding the raised potential and the falling element lowering the potential from the raised potential to the intermediate potential;

and performing discharge driving to drive the liquid discharge head to discharge a liquid, the discharge driving including:

inputting the first waveform to a pressure generation element of the liquid discharge head, interrupting an input of the first waveform to the pressure generation element while the higher potential is held in the first waveform, and inputting the second waveform to the pressure generation element while the raised potential is held in the second waveform.

14. The method according to claim 13, further comprising:

performing non-discharge driving to drive the liquid discharge head not to discharge the liquid, the non-discharge driving including inputting the second waveform to the pressure generation element.

15. The method according to claim 13, wherein, with the raising element of the first waveform, the potential rises stepwise from the lower potential to the higher potential.

16. The method according to claim 13, wherein the raising element of the first waveform includes at least two waveform elements different in potential change rate from each other.

17. The method according to claim 13, wherein the drive waveform further includes a third waveform different from the first waveform and the second waveform, the third waveform in which the potential falls from the intermediate potential and rises to the intermediate potential or higher than the intermediate potential.

18. The method according to claim 13, wherein the drive waveform further includes at least one additional second waveform.

* * * * *